US008883383B2

(12) United States Patent
Cote et al.

(10) Patent No.: US 8,883,383 B2
(45) **Date of Patent: *Nov. 11, 2014**

(54) CHARGE TRANSPORT LAYER COMPRISING FLUOROACYL ARYLAMINE

(71) Applicant: Xerox Corporation, Norwalk, CT (US)

(72) Inventors: Adrien P Cote, Clarkson (CA); Richard A Klenkler, Oakville (CA); Amanda L Bongers, Ottawa (CA); Gregory M McGuire, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/682,770

(22) Filed: Nov. 21, 2012

(65) Prior Publication Data

US 2014/0141365 A1 May 22, 2014

(51) Int. Cl.

| | |
|---|---|
| ***G03G 5/047*** | (2006.01) |
| ***G03G 5/06*** | (2006.01) |
| ***G03G 7/00*** | (2006.01) |

(52) U.S. Cl.

CPC ..... *G03G 7/0073* (2013.01); *G03G 5/0614* (2013.01); *G03G 5/0603* (2013.01); *G03G 5/0609* (2013.01)

USPC ..... 430/58.65; 430/58.75; 430/58.8; 430/73

(58) Field of Classification Search

USPC ..... 430/58.65, 58.75, 58.8, 58.85, 73

See application file for complete search history.

(56) References Cited

U.S. PATENT DOCUMENTS

| | | | | |
|---|---|---|---|---|
| 5,202,408 | A | 4/1993 | Yanus et al. | |
| 5,352,834 | A * | 10/1994 | Morishita et al. | 564/309 |
| 7,652,148 | B1 | 1/2010 | Cote et al. | |

OTHER PUBLICATIONS

Diamond, A.S., ed., Handbook of Imaging Materials, Marcel Dekker, Inc., NY (1991), pp. 383-384 and 395-396.*

* cited by examiner

*Primary Examiner* — Janis L Dote

(74) *Attorney, Agent, or Firm* — MDIP LLC

(57) ABSTRACT

A photoreceptor charge transport layer comprising a film-forming material or binder with a fluoroacyl arylamine charge transport molecule is described.

20 Claims, No Drawings

CHARGE TRANSPORT LAYER COMPRISING FLUOROACYL ARYLAMINE

FIELD

A novel charge transport layer (CTL) for an electrophotographic imaging device component is provided. The imaging device component can be used in electrophotographic devices.

BACKGROUND

In the electrophotographic imaging arts, the photoactive portions of most photoreceptors now are composed of organic materials. Nevertheless, the rigor and repetitive use thereof command resiliency of the components, such as, the photoreceptors.

High speed electrophotographic copiers, duplicators and printers often experience degradation of image quality over extended cycling and/or rapid cycling. The high speed imaging, duplicating and printing devices place stringent requirements on the imaging device components. For example, the functional layers of photoreceptors must be flexible, adhere well to adjacent layers and exhibit predictable electrical characteristics within narrow operating limits to provide acceptable toner images over many thousands of cycles.

Arylamines and arylamine derivatives are known but none comprise a fluoroacyl moiety with altered electronic properties.

SUMMARY

According to aspects disclosed herein, there is provided a photoreceptor charge transport layer (CTL) composition comprising a film-forming material, such as, a resin or a polymer, with a fluoroacyl arylamine as the charge transport material. In embodiments, the charge transport material is a fluoroacylated derivative of tetraphenlyenebiphenyldiamine or of paramethyl tetraphenlyenebiphenyldiamine.

DETAILED DESCRIPTION

As used herein, the term, "electrophotographic," or grammatic versions thereof, is used interchangeably with the term, "xerographic." The terms, "charge blocking layer" and "blocking layer," are used interchangeably with the terms, "undercoat layer" or "undercoat," or grammatic versions thereof "Photoreceptor," is used interchangeably with, "photoconductor," "imaging member" or "imaging component," or grammatic versions thereof. "Hole transport material/molecule," is used interchangeably with, "charge transport material/molecule."

For the purposes of the instant application, "about," is meant to indicate a deviation of no more than 20% of a stated value or a mean value. Other equivalent terms include, "substantial" and "essential," or grammatic forms thereof.

A "photoreceptor under construction," relates to a photoreceptor device that is being made and relates to partially constructed devices containing a substrate and one or more functional, required and/or optional layers. Thus, for example, a photoreceptor under construction relative to a CTL is a partially constructed photoreceptor comprising at least a substrate and a charge generating layer (CGL). A photoreceptor under construction relative to an overcoat relates to a partially constructed photoreceptor comprising at least a substrate, a CGL and a CTL.

In electrophotographic reproducing or imaging devices, including, for example, a digital copier, an image-on-image copier, a contact electrostatic printing device, a bookmarking device, a facsimile device, a printer, a multifunction device, a scanning device and any other such device, a printed output is provided, whether black and white or color, or a light image of an original is recorded in the form of an electrostatic latent image on an imaging device component, such as, a photoreceptor, which may be present as an integral component of an imaging device or as a replaceable component or module of an imaging device, and that latent image is rendered visible using electroscopic, finely divided, colored or pigmented particles, or toner. The imaging device component or photoreceptor can be used in electrophotographic (xerographic) imaging processes and devices, for example, as a flexible belt or in a rigid drum configuration. Other components may include a flexible intermediate image transfer belt, which can be seamless or seamed.

The imaging device component, the photoreceptor, generally comprises one or more functional layers. Certain photoreceptors include a photoconductive layer or layers formed on an electrically conductive substrate or surface. The photoconductive layer can be an insulator in the dark so that electric charge is retained on the surface thereof, which charge is dissipated on exposure to light. In embodiments, a photoreceptor comprises a CTL comprising a fluoroacylated arylamine.

One type of composite photoconductive layer used in xerography is illustrated in U.S. Pat. No. 4,265,990 which describes an imaging device component having at least two electrically operative layers, a photoconductive layer which photogenerates holes and injects the photogenerated holes into a CTL. The photoreceptors can carry a uniform negative or positive electrostatic charge to generate an image which is visualized with finely divided electroscopic colored or pigmented particles.

Embodiments of the present imaging device component or photoreceptor can be used in an electrophotographic image forming device or printing device. Hence, the imaging device component or photoreceptor is electrostatically charged and then is exposed to a pattern of activating electromagnetic radiation, such as, light, which dissipates the charge in the illuminated areas of the imaging device component while leaving behind an electrostatic latent image in the non-illuminated areas. The electrostatic latent image then is developed at one or more developing stations to form a visible image by depositing finely divided electroscopic colored, dyed or pigmented particles, or toner, for example, from a developer composition, on the surface of the imaging component. The resulting visible image on the photoreceptor is transferred to a suitable receiving member, such as, a paper. Alternatively, the developed image can be transferred to an intermediate transfer device, such as, a belt or a drum, and the image then is transferred to a receiving member, such as, a paper, or various other receiving members or substrates, such as, a cloth, a polymer, a plastic, a metal and so on, which can be presented in any of a variety of forms, such as, a flat surface, a sheet or a curved surface. The transferred colored particles are fixed or fused to the receiving member by any of a variety of means, such as, by exposure to elevated temperature and/or pressure.

Thus, a photoreceptor can include a support or a substrate; which may comprise a conductive surface or a conductive layer or layers (which may be referred to herein as a ground plane layer) on an inert support; a CGL; a CTL; and a protective layer or overcoat. Other optional functional layers that can be included in a photoreceptor include a hole blocking layer; an undercoat; an adhesive interface layer; a ground strip; an anti-curl back coating layer and so on. It will be appreciated that one or more of the layers may be combined into a single layer.

The Substrate

The imaging device component substrate (or support) may be opaque or substantially transparent, and may comprise any suitable organic or inorganic material having the requisite mechanical properties. The entire substrate can comprise an electrically conductive material, or an electrically conductive material can be a coating on an inert substrate. Any suitable electrically conductive material can be employed, such as, copper, brass, nickel, zinc, chromium, stainless steel, conductive plastics and rubbers, aluminum, semitransparent aluminum, steel, cadmium, silver, gold, indium, tin, zirconium, niobium, tantalum, vanadium, hafnium, titanium, tungsten, molybdenum, alloys thereof and so on; or a paper, a plastic, a resin, a polymer and the like rendered conductive by the inclusion of a suitable conductive material therein or thereon; metal oxides, including tin oxide and indium tin oxide; and the like. The conductive material can comprise a single of the above-mentioned materials, such as, a single metallic compound, or a plurality of materials and/or a plurality of layers of different components, such as, a metal or an oxide, plural metals and so on.

The substrate can be an insulating material including inorganic or organic polymeric materials, such as, a commercially available biaxially oriented polyethylene terephthalate, a commercially available polyethylene naphthalate and so on, with a ground plane layer comprising a conductive coating comprising one or more of the materials provided hereinabove, including a titanium or a titanium/zirconium coating, or a layer of an organic or inorganic material having a semiconductive surface layer, such as, indium tin oxide, aluminum, titanium and the like. Thus, a substrate can be a plastic, a resin, a polymer and so on, such as, a polycarbonate, a polyamide, a polyester, a polypropylene, a polyurethane, a polyethylene and so on.

The substrate may have a number of many different configurations, such as, for example, a plate, a sheet, a film, a cylinder, a drum, a scroll, a flexible belt, which may be seamed or seamless, and the like.

The thickness of the substrate can depend on any of a number of factors, including flexibility, mechanical performance and economic considerations. The thickness of the substrate may range from about 25 μm to about 3 mm. In embodiments of a flexible imaging belt, the thickness of a substrate can be from about 50 μm to about 200 μm for flexibility and to minimize induced imaging device component surface bending stress when a imaging device component belt is cycled around small diameter rollers in a machine belt support module, for example, such as, a 19 mm diameter roller.

Generally, a substrate is not soluble in any of the solvents used in the coating layer solutions, can be optically transparent or semi-transparent, and can be thermally stable up to a temperature of about 150° C. or more.

The surface of a support may be treated chemically or mechanically to enhance binding of a layer thereto. Thus, the surface by be roughened by abrasion or treatment with, for example, an acid.

The Conductive Layer

When a conductive ground plane layer is present, the layer may vary in thickness depending on the optical transparency and flexibility desired for the electrophotographic imaging device component. When an imaging flexible belt is used, the thickness of the conductive layer on the substrate, for example, a titanium and/or a zirconium conductive layer produced by sputtering, typically ranges from about 2 nm to about 75 nm in thickness to allow adequate light transmission for proper back erase. In other embodiments, a conductive layer can be from about 10 nm to about 20 nm in thickness for a combination of, for example, electrical conductivity, flexibility or light transmission. For rear erase exposure, a conductive layer light transparency of at least about 15% can be used.

The conductive layer may be an electrically conductive metal layer which may be formed, for example, on the substrate by any suitable coating technique, such as, a vacuum depositing, dipping or sputtering and so on as taught herein or as known in the art, and the coating dried on the substrate using methods taught herein or known in the art. (Those and any of the materials and methods for making a layer as taught herein may be practiced for making any other layer of a photoreceptor.)

Typical metals suitable for use in a conductive layer include aluminum, zirconium, niobium, tantalum, vanadium, hafnium, titanium, nickel, stainless steel, chromium, tungsten, molybdenum, combinations thereof and the like. The conductive layer need not be limited to metals. Hence, other examples of conductive layers include combinations of materials, such as, conductive indium tin oxide as a transparent layer for light having a wavelength between about 4000 Å and about 9000 Å or a conductive carbon black dispersed in a plastic binder as an opaque conductive layer.

The Hole Blocking Layer

An optional hole blocking layer may be applied, for example, to the undercoat. Any suitable positive charge (hole) blocking layer capable of forming an effective barrier to the injection of holes from the adjacent conductive layer or substrate to the photoconductive layer(s) or CGL may be used.

The hole blocking layer may include films or polymers, such as, a polyvinylbutyral, epoxy resins, polyesters, polysiloxanes, polyamides, polyurethanes, methacrylates, such as hydroxyethyl methacrylate (HEMA), hydroxylpropyl celluloses, polyphosphazines and the like, or may comprise nitrogen-containing siloxanes or silanes, or nitrogen-containing titanium or zirconium compounds, such as, titanate and zirconate. (Such film-forming materials can be used to make any of the layers taught herein.)

The hole blocking layer may have a thickness of from about 0.2 μm to about 10 μm, depending on the type of material chosen as a design choice.

Typical hole blocking layer materials include, for example, trimethoxysilylpropylenediamine, hydrolyzed trimethoxysilylpropylethylenediamine, N-β-(aminoethyl)-γ-aminopropyltrimethoxysilane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino) titanate, isopropyl trianthranil titanate, isopropyl tri(N,N-dimethylethylamino) titanate, titanium-4-aminobenzenesulfonate oxyacetate, titanium 4-aminobenzoate isostearate oxyacetate, (γ-aminobutyl)methyl diethoxysilane, (γ-aminopropyl)methyl diethoxysilane and combinations thereof, as disclosed, for example, in U.S. Pat. Nos. 4,338,387; 4,286,033; 4,988,597; 5,244,762; and 4,291,110, each incorporated herein by reference in entirety.

The blocking layer may be applied by any suitable conventional technique, such as, spraying, dip coating, draw bar coating, gravure coating, silk screening, air knife coating, reverse roll coating, vacuum deposition, chemical treatment and the like. For convenience in obtaining thin layers, the blocking layer may be applied in the form of a dilute solution, with the solvent being removed after deposition of the coating by conventional techniques, such as, vacuum, heating and the like. A weight ratio of blocking layer material and of solvent of between about 0.05:100 to about 5:100 can be used for spray coating. Such deposition methods for forming layers can be used for making any of the herein described layers.

The Adhesive Interface Layer

An optional adhesive interface layer may be employed. An interface layer may be situated, for example, intermediate between the hole blocking layer and the CGL. The interface layer may include a film-forming material, such as, a polyurethane, a polyester and so on. An example of a polyester includes a polyarylate, a polyvinylbutyral and the like.

Any suitable solvent or solvent mixture may be employed to form an adhesive interface layer coating solution. Typical solvents include tetrahydrofuran, toluene, monochlorobenzene, methylene chloride, cyclohexanone and the like, as well as mixtures thereof. Any suitable and conventional technique may be used to mix and thereafter to apply the adhesive interface layer coating mixture to the photoreceptor under construction as taught herein or as known in the art. Typical application techniques include spraying, dip coating, roll coating, wire wound rod coating and the like. Drying of the deposited wet coating may be by any suitable conventional process, such as oven drying, infrared drying, air drying and the like.

The adhesive interface layer may have a thickness of from about 0.01 μm to about 900 μm after drying. In certain embodiments, the dried thickness is from about 0.03 μm to about 1 μm.

The Charge Generating Layer

The CGL can comprise any suitable charge generating binder or film-forming material including a charge generating/photoconductive material suspended or dissolved therein, which may be in the form of particles and dispersed in a film-forming material or binder, such as an electrically inactive resin. Examples of charge generating materials include, for example, inorganic photoconductive materials, such as, azo materials, such as, certain dyes, such as, SUDAN RED and DIANE BLUE, cyclic aromatic pigments, inorganic pigments, quinone pigments, cyanine pigments and so on, amorphous selenium, trigonal selenium and selenium alloys, such as, selenium-tellurium, selenium-tellurium-arsenic, selenium arsenide and mixtures thereof, germanium and organic photoconductive materials, including various phthalocyanine pigments, such as, the X form of metal-free phthalocyanine, metal phthalocyanines, such as, vanadyl phthalocyanine, copper phthalocyanine, hydroxygallium phthalocyanines, chlorogallium phthalocyanines, titanyl phthalocyanines and so on, quinacridones, dibromo anthanthrone pigments, benzimidazole perylenes, substituted 2,4-diaminotriazines, polynuclear aromatic quinones and the like, dispersed or suspended in a film-forming material, such as, a polymer or a binder. Selenium, selenium alloy and the like and mixtures thereof may be formed as a homogeneous CGL. Benzimidazole perylene compositions are described, for example, in U.S. Pat. No. 4,587,189, the entire disclosure thereof being incorporated herein by reference. Multicharge generating layer compositions may be used where a photoconductive layer enhances or reduces the properties of the CGL. The charge generating materials can be sensitive to activating radiation having a wavelength from about 400 nm to about 900 nm during the imagewise radiation exposure step forming an electrostatic latent image. For example, hydroxygallium phthalocyanine absorbs light of a wavelength of from about 370 nm to about 950 nm, as disclosed, for example, in U.S. Pat. No. 5,756,245.

Any suitable film-forming material may be employed in a CGL, including those described, for example, in U.S. Pat. No. 3,121,006, the entire disclosure thereof being incorporated herein by reference, or as taught herein. Typical film-forming materials include thermoplastic and thermosetting resins, such as, a polycarbonate, a polyester, a polyamide, a polyurethane, a polystyrene, a polyarylether, a polyarylsulfone, a polybutadiene, a polysulfone, a polyethersulfone, a polyethylene, a polypropylene, a polyimide, a polymethylpentene, a polyphenylenesulfide, a polyvinylbutyral, a polyvinyl acetate, a polysiloxane, a polyacrylate, a polyvinylacetal, an amino resin, a phenyleneoxide resin, a terephthalic acid resin, an epoxy resin, a phenolic resin, an acrylonitrile copolymer, a polyvinylchloride, a vinylchloride, a vinyl acetate copolymer, an acrylate copolymer, an alkyd resin, a cellulosic film former, a poly(amideimide), a styrene-butadiene copolymer, a vinylidenechloride/vinylchloride copolymer, a vinylacetate/vinylidene chloride copolymer, a styrene-alkyd resin and the like. Another film-forming material is PCZ-400 (poly (4,4'-dihydroxy-diphenyl-1-1-cyclohexane) with a viscosity/molecular weight of about 40,000. A copolymer can be a block or a graft, random or alternating, and so on. The materials, polymers and copolymers mentioned herein can be used in any of the layers taught herein.

The charge generating material can be present in the film-forming material or binder composition in various amounts. Generally, from about 5% by weight or volume to about 90% by weight or volume of the charge generating material is dispersed in about 10% by weight or volume to about 95% by weight or volume of the film-forming material or binder, or from about 20% by volume to about 60% by volume of the charge generating material is dispersed in about 40% by volume to about 80% by volume of the film-forming material or binder composition.

The CGL containing the charge generating material and the binder or film-forming material generally ranges in thickness from about 0.1 μm to about 5 μm, from about 0.3 μm to about 3 μm when dry. The CGL thickness can be related to film or binder content, higher film or binder content compositions can employ thicker layers for charge generation.

In some embodiments, the CGL may comprise a charge transport molecule or component, as discussed below in regard to the CTL. The charge transport molecule may be present in some embodiments from about 1% to about 60% by weight of the total weight of the CGL.

The Charge Transport Layer

The CTL generally is superior or exterior to the CGL on a photoreceptor and includes a suitable film-forming material, such as, a transparent organic polymer or non-polymeric material capable of supporting the injection of photogenerated holes or electrons from the CGL and capable of allowing the transport of the holes/electrons through the CTL to selectively discharge the charge on the surface of the imaging device component, such as, a photoreceptor. The CTL can be a substantially non-photoconductive material, but one which supports the injection of photogenerated holes from the CGL. The CTL is normally transparent in a wavelength region in which the electrophotographic imaging device component is to be used when exposure is effected therethrough to ensure that most of the incident radiation is utilized by the underlying CGL. Thus, the CTL exhibits optical transparency with negligible light absorption and negligible charge generation when exposed to a wavelength of light useful in, for example, xerography, e.g., from about 400 nm to about 900 nm. In the case when the imaging device component is prepared with transparent materials, imagewise exposure or erase may be accomplished through the substrate with all light passing through the back side of the substrate. In that case, the materials of the CTL need not transmit light in the wavelength region of use if the CGL is sandwiched between the substrate and the CTL.

In one embodiment, the CTL not only serves to transport holes, but also, in part, to protect the CGL from abrasion or chemical attack and may therefore extend the service life of the imaging device component.

The CTL may include any suitable charge transport molecule or activating compound useful as an additive, which may be a symmetric molecule, molecularly dispersed in an electrically inactive polymeric film-forming material or binder to form a solution and thereby making the material electrically active. The charge transport molecule may be added to a film-forming polymeric material, a film-forming material or binder which is otherwise incapable of supporting the injection of photogenerated holes from the charge generation material and incapable of allowing the transport of the holes therethrough. The charge transport molecule typically comprises small molecules of an organic compound, which may be a symmetric molecule, which cooperate to transport charge between molecules and ultimately to the surface of the CTL, for example, see U.S. Pat. Nos. 7,759,032 and 7,704,658.

For example, N,N,N',N'-tetra(4-methylphenyl)-(1,1'-biphenyl)-4,4'-diamine can be used as a charge transport molecule. Other suitable symmetric charge transport molecules include other arylamines, such as aryl diamines, such as, aromatic diamines; and combinations thereof.\

Arylamines of interest are improved over known arylamines by derivatizing same with one or more fluoroacyl moieties without Lewis acids and a Friedel-Crafts acylation reaction. Fluoroacyl arylamines are obtained from an arylamine and a trifluoroacyl-donating reagent, such as, trifluoroacetate or compounds containing trifluoroacetate, trifluoroacetic anhydride and so on in a single reaction scheme without using a Lewis acid.

While not wishing to be bound by any particular theory, the one or more fluoroacyl groups added to an arylamine as produced by the present method of interest, impart new electronic properties and configurations to conventional arylamine electronic material. Hence, the arylamines carrying one or more fluoroacyl groups have different and/or improved properties, such as, charge transport properties, and are useful for a number of different electronic and other industrial uses.

The term, "arylamine," refers, for example, to moieties containing both aryl and amine groups. Exemplary arylamines have the structure Ar—NRR', in which Ar represents an aryl group and R and R' are groups that independently may be selected from hydrogen and substituted and unsubstituted alkyl, alkenyl, aryl and other suitable functional groups. The term, "triarylamine," refers, for example, to arylamine compounds having the general structure NArAr'Ar", in which Ar, Ar' and A" represent independently selected aryl groups, which may be substituted, functionalized and so on.

A fluoroacyl arylamine may be a symmetric molecule. In certain embodiments of the present invention, the fluoroacyl arylamine of interest may be a planar molecule, particularly when held by hydrogen bonds from the fluoroacyl moiety to the core arylamine structure.

In an embodiment, an arylamine substrate of interest comprises the structure:

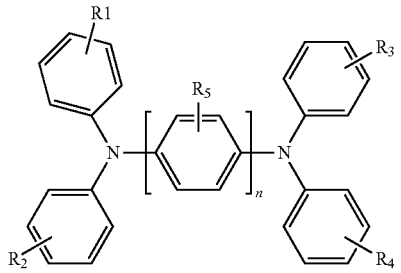

where $R_1$, $R_2$, $R_3$, $R_4$ and $R_5$ may be located at any site on a phenyl or aryl group; and can be one or more hydrogen atoms, a halogen, a hydrocarbon, which can be substituted or can contain a heteroatom, such as, N, O, S and so on, of 1 to about 8 carbon atoms, for example, alkyl, alkenyl, aryl, hydroxyl, oxyalkyl and so on; or a functional group comprising a reactive moiety or site; and n is 0, 1, 2 or 3. A functional group can comprise a hydroxyl group, a carbonyl group, a halogen, an amino group and so on, as a design choice.

The trifluoroacyl-donating reagent can be an acid, an anhydride thereof and so on. An example of an acid anhydride is one with the formula:

$$R—CO—O—CO—CF_3$$

where R may be $CF_3$, alkyl, aryl, substituted alkyl or substituted aryl, where the substitutions may be halogen, hydroxy or nitro, wherein the alkyl or aryl may have between 1 and about 8 carbon atoms.

The synthesis reaction occurs in a suitable solvent system which dissolves both the trifluoroacyl-donating reagent, such as, a trifluoro anhydride, such as, trifluoroacetic anhydride, and the arylamine reagent, and is inert to the reaction between the two substrates or reactants. The liquid reaction mixture may comprise one compound or a mixture of two or more solvent compounds. Typically, the reaction mixture is not miscible significantly with water so that the resulting product may be isolated by phase separation. Suitable solvents include hydrocarbons, ethers, long chain alcohols, hydrocarbons derivatized by halogens, ethers or long chain alcohols, and mixtures thereof. Compatible liquids with higher boiling points may be used to allow the reaction to occur at a higher temperature. Examples include halogenated hydrocarbons, aliphatic nitriles, alkanes and so on, such as, but not limited to, dicholoromethane, hexane, acetonitrile and so on.

In an embodiment, the arylamine also may be structure A or B:

A

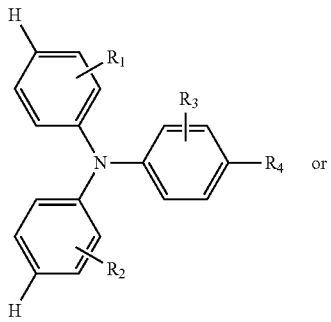

or

-continued

B

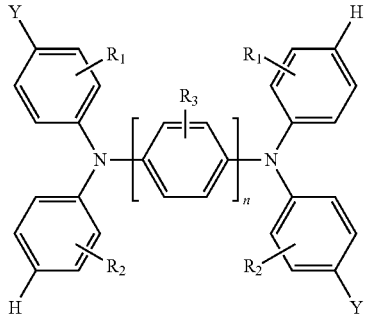

wherein Y is hydrogen, $C_1$-$C_5$ alkyl, $C_3$-$C_7$ cyclic alkyl, $C_1$-$C_4$ alkoxy, hydroxy, ω-hydroxy substituted $C_2$-$C_8$ alkyl, halogen or aryl, optionally substituted with $C_1$-$C_5$ alkyl; $R_1$, $R_2$ and $R_3$ each is hydrogen, $C_1$-$C_5$ alkyl, $C_3$-$C_7$ cyclic alkyl, $C_1$-$C_4$ alkoxy, hydroxy, ω-hydroxy substituted $C_2$-$C_8$ alkyl, halogen or aryl, optionally substituted with $C_1$-$C_5$ alkyl; and $R_4$ is $C_1$-$C_5$ alkyl, $C_3$-$C_7$ cyclic alkyl, hydroxy, ω-hydroxy substituted $C_z$—$C_8$ alkyl, halogen or aryl optionally substituted with $C_1$-$C_5$ alkyl; and n is 1, 2 or 3.

In another embodiment, the arylamine may be:

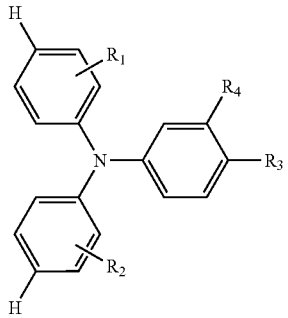

wherein $R_1$, $R_2$, $R_3$ and $R_4$ are as defined above.

In another embodiment, structure B has a structure:

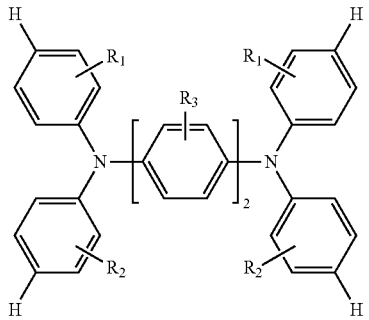

wherein $R_1$, $R_2$ and $R_3$ are as defined above.

Alternatively, compound B has a structure:

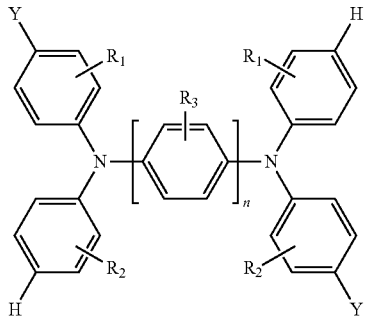

wherein Y is methyl, and n, $R_1$, $R_2$ and $R_3$ area as defined above.

In another embodiment, the arylamine is selected from the group consisting of:

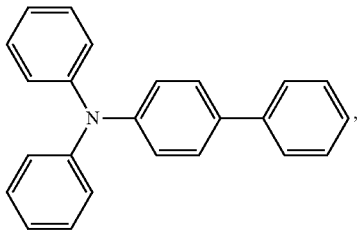

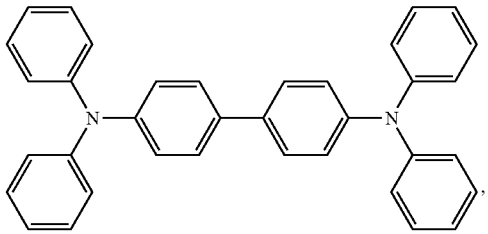

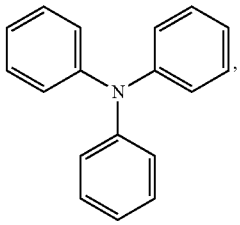

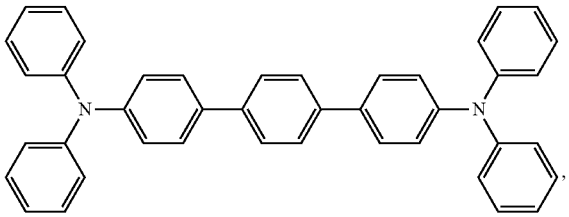

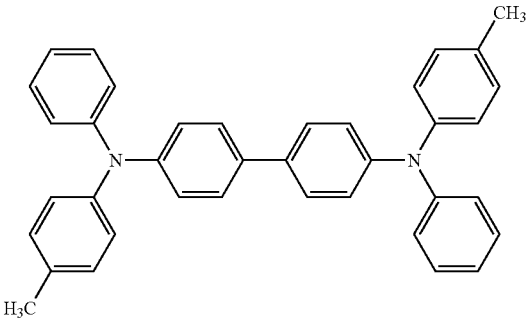

and

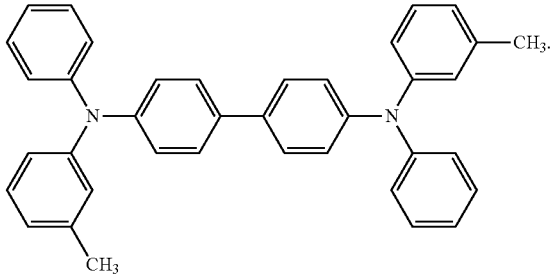

Hence, a fluoroacyl arylamine of interest can comprise:

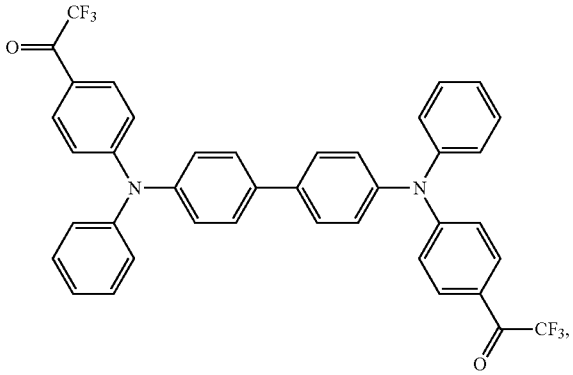

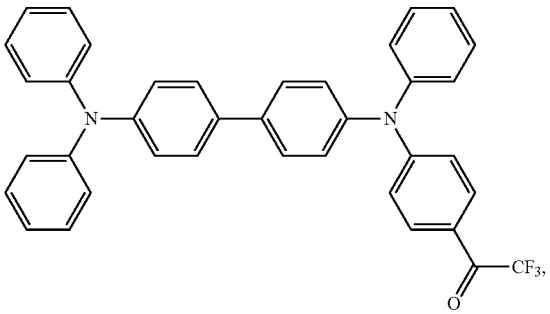

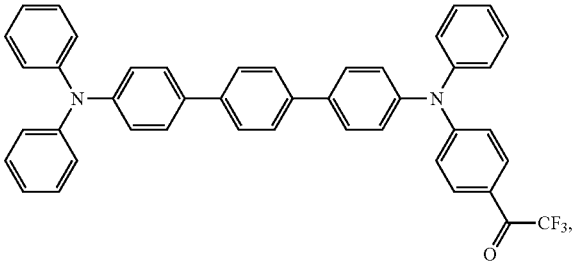

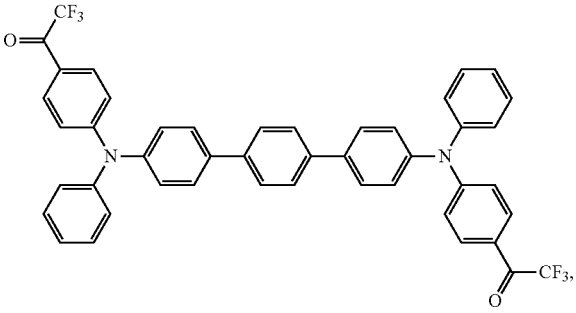

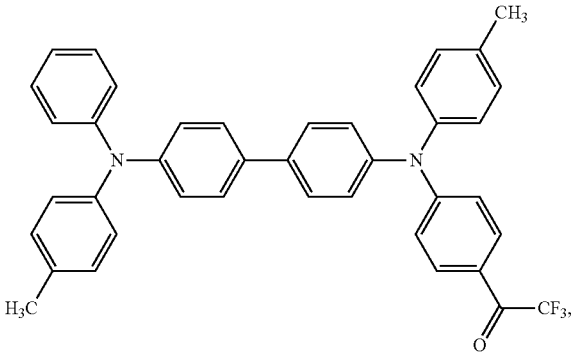

-continued

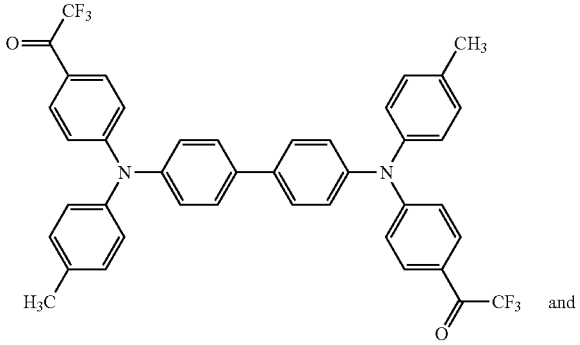

and

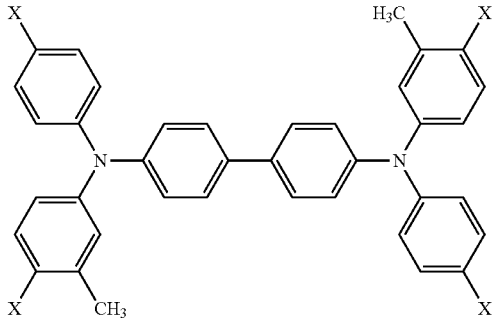

wherein X is a fluoroacyl group or hydrogen and the number of fluoroacyl groups ranges from 1 to 4,

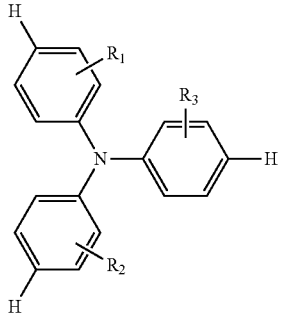

wherein $R_1$ $R_2$ and $R_3$ are as defined above; and at least one ring comprises at least one fluoroacyl moiety;

B

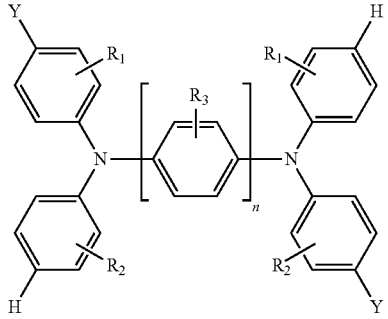

wherein n, Y, $R_1$ $R_2$ and $R_3$ are as defined above; and at least one ring comprises at least one fluoroacyl moiety;

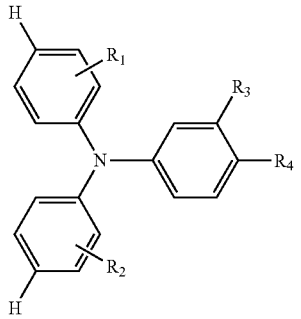

wherein $R_1$, $R_2$, $R_3$ and $R_4$ are as defined above, and one or more rings comprise at least one fluoroacyl moiety; or

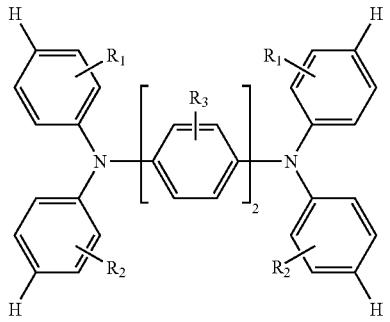

wherein $R_1$, $R_2$ and $R_3$ are as defined above, and one or more of the rings comprise at least one fluoroacyl moiety.

The temperature and pressure of the reaction are such that the reaction mixture remains in liquid form and continues to dissolve all of the chemical reactants. The conditions may vary with the reagents and/or solvent(s).

The reaction may occur in a reactor maintained at room temperature or slightly higher. The reaction temperatures can be from about 25° C. to about 90° C., from about 30° C. to about 80° C., from about 40° C. to about 70° C. Higher temperatures may be used with suitable solvents which do not become overly volatile at those elevated temperatures. Higher temperatures also may be used to increase the rate of reaction. To reduce solvent loss or to facilitate reaction kinetics, the reaction may occur under reflux, occur in closed conditions or under pressure, for example.

The reaction time may vary with the temperature and individual starting materials. The more reactive the trifluoroacyl-donating compound and/or the higher the temperature, reaction time may be abbreviated. The reaction time also may vary with the particular arylamine substrate and the number and location of fluoroacyl moieties that are incorporated in the product.

During the reaction, progress may be monitored by observation of solution color, solution turbidity and so on, which parameters can be monitored visually or using an appropriate sensor. A sample may be removed periodically and analyzed by, for example, HPLC or other analytic method, or a sample may flow from the main reaction vessel by or through a sensor or other monitoring device, such as, a spectrophotometer.

After the reaction is completed, the final product resembles the arylamine substrate but with one or more fluoroacyl moieties attached to one or more of the pendant aryl moieties. In embodiments, the fluoroacyl moiety can be attached in the para position, however, the fluoroacyl residue can be located at other positions of an aryl ring. Also, any one aryl group may contain more than one fluoroacyl group. An acid byproduct also may be produced from an acid anhydride reagent.

The final fluoroacyl arylamine product can be separated by removal, precipitation and/or inactivation of any reagent or byproduct, such as, an acid byproduct when using an anhydride, such as, by neutralization. The solution also can be removed, such as, by evaporation and/or precipitating the product. Acid byproducts, such as, trifluoroacetic acid when an anhydride is used, can be dissolved in aqueous solutions and may be washed with aqueous or ionic liquids to be separated from the fluoroacyl arylamine-containing solution. The final fluoroacyl arylamine product also may be dried to remove residual solvent, reactants and water, for example, by vacuum and/or heat. Complete removal of solvent, liquid reactants and/or water may be determined when the weight remains constant.

Because of the reaction scheme and kinetics, little may need to be done to purify the fluoroacyl arylamine compound from the reaction mixture, although additional separation, filtration, and/or purification processes can be conducted, as desired, to a desired purity level or as needed, for example, based on the starting reagents. For example, the desired fluoroacylated arylamine product can be subjected to conventional organic washing steps, can be separated, can be decolorized (if necessary), treated with known absorbents (such as silica, alumina, carbon, clays and the like, if necessary) and the like. The final product can be isolated, for example, by a suitable precipitation or crystallization procedure. Such procedures are conventional and will be apparent to those skilled in the art.

The resulting fluoroacylated arylamine may have 1, 2 or more fluoroacyl moieties attached to any of the aromatic rings at any position. Certain positions of attachment may be selected as a design choice from a reaction standpoint, others may be synthesized by adjusting the trifluoroacyl-donating molecule and reaction conditions. The molar amount of trifluoroacyl-donating molecule in the reaction can determine the number of fluoroacyl moieties attached to the arylamine core structure.

The fluoroacylated arylamine can be used as a final product or can be further processed and/or reacted to provide other compounds for similar or different uses. For example, the fluoroacylarylamine may be used in a composition, for example, as a charge transport molecule in a CTL of an electrophotographic imaging member. The compounds of interest comprise one or more reactive carbonyl groups or can be synthesized to comprise other functional or reactive groups. Hence, the compounds of interest can be used as reagent for producing other compounds, polymers and so on, practicing materials and methods known in the art as a design choice. Hence, the fluoroacyl arylamine molecules can be used to produce polymers and copolymers resulting from chemical reaction(s) to add additional reactive moieties or functional groups to the fluoroacyl arylamine core where the functional groups can react in a polymerization reaction; polymerization of fluoroacyl arylamine molecules; further derivatization of fluoroacyl arylamines; using a fluoroacyl arylamine as a starting material to synthesize another novel compound retaining the basic fluoroacyl arylamine structure; and so on.

The reaction of interest produces product in high yield, high purity or both without byproduct (other than the intended acid byproduct when an anhydride is used) or starting material contamination. In bench top laboratory experiments, yields of about 70% or more are obtained with purities greater than about 90%.

The synthesis reaction of interest does not require or use a Lewis acid or other metal, which later needs to be removed or which can interfere with purification of the fluoroacyl arylamine product.

Traditionally, multiple chemical reactions were required to synthesize different arylamines. On the other hand, the reaction of interest may be done simply, for example, in a single vessel, as a one-step reaction or both without need for multiple reactions, multiple reagent introductions, complicated purification schemes and so on, which raise cost and make product purity more difficult to obtain.

The final chemical structure of the fluoroacyl arylamine products may be determined by HPLC, LC/MS, $^{1}$H NMR, $^{19}$F NMR, FT-IR, elemental analysis, crystallography and so on.

The fluoroacylated arylamine charge transport molecule of interest may be present at about 1% to about 70% by weight of the total weight of the CTL, from about 10% to about 70% by weight of the total weight of the CTL, from about 20% to about 70%; from about 30% to about 70%; or from about 40% to about 70% of the total weight of the CTL. (The above amounts and percentages, including those presented elsewhere in the specification, are in terms of or relative to w/v, w/w or v/w as appropriate for the material(s).) The remainder of a CTL can comprise any suitable electrically inactive film-forming material or binder which may be a single species or a mixture of two or more species.

Typical inactive film-forming materials or binders include, a polycarbonate resin, a polystyrene, a polyester, a polyarylate, a polyacrylate, a polyether, a polyethylene, which may be substituted, for example, with a hydrocarbon, a halogen, a polysulfone, a fluorocarbon, a thermoplastic polymer and the like. Molecular weights can vary, for example, from about 20,000 to about 150,000. Examples of film-forming materials or binders include a polycylic phenol, a polycarbonate, such as, a polycarbonate comprising an aryl group, such as, poly (4,4'-isopropylidene-diphenylene)carbonate (bisphenol-A-polycarbonate or PCA), poly(4,4'-cyclohexylidine-diphenylene)carbonate (bisphenol-Z-polycarbonate or PCZ), poly (4,4'-isopropylidene-3,3'-dimethyl-diphenyl)carbonate (bisphenol-C-polycarbonate or PCC), a bisphenol B polycarbonate, PCZ-800 (Mitsubishi Gas Chemical Co.), APEC high-heat polycarbonate (PC) resin from Bayer, such as, polymers DPI-9379 and 1745, a bisphenol F polycarbonate, a bisphenol S polycarbonate and the like and mixtures thereof. Such bisphenol-based carbonates can be polymerized by reacting a bisphenol with a base, such as, sodium hydroxide, phosgene and so on, as known in the art.

Lubricating agents can be included in a CTL. Suitable lubricants include a polyether (for example, see U.S. Pat. No. 7,427,440); one with antioxidizing activity, as taught, for example, in U.S. Pat. No. 7,544,451; a phosphorus-containing compound, such as phosphite or a phosphoric acid amine salt, for example, as provided in U.S. Pat. No. 7,651,827; a synthetic hydrocarbon; a polyolefin; a polyolester; a thiocarbonate; a fluorinated resin, such as, a polytetrafluoroethylene (PTFE); copolymers of a fluorinated resin, such as, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene and vinylidene fluoride, mixtures thereof, and the like, inclusive of a number of suitable known fluorinated polymers; a lamellar solid; a polyethylene; a polypropylene and so on, for example, as provided, for example, in U.S. Pat. Nos. 7,527,902 and 7,468,208.

Crosslinking agents can be used to promote polymerization of the polymer or film-forming material of a CTL. Examples of suitable crosslinking agents include an acrylated polystyrene, a methacrylated polystyrene, an ethylene glycol dimethacrylate, a bisphenol A glycerolate dimethacrylate, a (dimethylvinylsilyloxy)heptacyclopentyltricycloheptasiloxanediol and the like and mixtures thereof. The crosslinking agent can be used in an amount of from about 1% to about 20%, or from about 5% to about 10%, or from about 6% to about 9% by weight or volume of total polymer or film-forming material content.

The CTL can contain variable amounts of an antioxidant, such as, a hindered phenol. An example of a hindered phenol is octadecyl-3,5-di-tert-butyl-4-hydroxyhydrociannamate. The hindered phenol may be present in an amount of up to about 10 weight % based on the concentration or amount of the charge transport molecule. Other suitable antioxidants are described, for example, in U.S. Pat. No. 7,018,756, incorporated herein by reference in entirety.

Any suitable and conventional technique may be used to mix and thereafter to apply the CTL coating mixture to the photoreceptor under construction. Typical application techniques include spraying, dip coating, roll coating, wire wound rod coating and the like. Drying of the deposited coating may be obtained by any suitable conventional technique such as oven drying, infrared drying, air drying and the like.

The CTL can be an insulator to the extent that the electrostatic charge placed on the CTL is not conducted in the absence of illumination at a rate sufficient to prevent formation and retention of an electrostatic latent image thereon. In general, the ratio of the thickness of the CTL to the CGL is from about 2:1 to about 200:1, as great as about 400:1.

The thickness of the CTL can be from about 5 μm to about 200 μm, from about 15 μm to about 40 μm. The CTL may comprise dual layers or plural layers, and each layer may contain different concentrations of a charge transporting component or may contain different charge transporting components.

The Ground Strip Layer

Another possible layer is a ground strip layer, including, for example, conductive particles dispersed in a film-forming material or binder, which may be applied to one edge of the imaging device component to promote electrical continuity, for example, with the conductive layer or the substrate. The ground strip layer may include any suitable film-forming material, polymer or binder and electrically conductive particles as taught herein. Typical ground strip materials include those enumerated in U.S. Pat. No. 4,664,995, the entire disclosure of which is incorporated by reference herein.

The Overcoat Layer

An overcoat layer provides imaging device component surface protection, improved cleanability, reduced friction as well as improved resistance to abrasion.

An overcoat layer can include at least a film-forming material or binder, such as, a resin, and optionally, can include a hole transporting molecule, which may be symmetric, such as, a terphenyl diamine hole transporting molecule or a fluoroacyl arylamine of interest. The overcoating layer can be formed, for example, from a solution or other suitable mixture of the film-forming material or binder, such as, a resin.

The film-forming material or binder, such as, a resin, used in forming the overcoating layer can be any suitable film-forming material or binder, such as, a resin, including any of those described herein. The film-forming material or binder, such as, a resin, can be electrically insulating, semi-conductive or conductive, and can be hole transporting or not hole transporting. Thus, for example, suitable film-forming materials or binders, such as, resins, can be selected from, but are not limited to, thermoplastic and thermosetting resins, such as, polycarbonates, polyesters, polyamides, polyurethanes, polystyrenes, polyarylethers, polyarylsulfones, polysulfones, polyethersulfones, polyphenylene sulfides, polyvinyl acetate, polyacrylates, polyvinyl acetals, polyamides, polyimides, amino resins, phenylene oxide resins, phenoxy resins, epoxy resins, phenolic resins, polystyrenes, acrylonitriles, copolymers, vinyl acetate copolymers, acrylate copolymers, alkyd resins, styrenebutadiene copolymers, styrene-alkyd resins, polyvinylcarbazole and the like. A copolymer may be block, graft, random or alternating.

The film-forming material or binder, such as, a resin, can be a polyester polyol, such as, a branched polyester polyol. The prepolymer can be synthesized using a significant amount of a polyfunctional monomer, such as, trifunctional alcohols, such as, triols, to form a polymer having a significant number of branches off the main polymer chain. That is distinguished from a linear prepolymer that contains only difunctional monomers, and thus, few or no branches off the main polymer chain. As used herein, "polyester polyol," is meant to encompass such compounds that include multiple ester groups as well as multiple alcohol (hydroxyl) groups in the molecule, and which can include other groups, such as, for example, ether groups, amino groups, sulfhydryl groups and the like.

Examples of such suitable polyester polyols include, for example, polyester polyols formed from the reaction of a polycarboxylic acid, such as, a dicarboxylic acid or a tricarboxylic acid (including acid anhydrides) with a polyol, such as, a diol or a triol. The number of ester and alcohol groups, and the relative amount and type of a polyacid and a polyol, are selected such that the resulting polyester polyol compound retains a number of free hydroxyl groups, which can be used for subsequent crosslinking or derivatization in forming the overcoat film-forming material or binder material. For example, suitable polycarboxylic acids include, but are not limited to, adipic acid, pimelic acid, suberic acid, azelaic acid, sebasic acid and the like. Suitable polyols include, but are not limited to, difunctional materials, such as, glycols or trifunctional alcohols, such as, triols and the like, including propanediols, butanediols, hexanediols, glycerine, 1,2,6-hexane triols and the like. Reference is made to U.S. Pub. No. 2009/0130575.

In forming the film-forming material or binder for the overcoating layer in embodiments where the film-forming material or binder is a polyester polyol, a polyol, or a combination thereof, any suitable crosslinking agent, a catalyst and the like can be included in known amounts for known purposes. For example, a crosslinking agent or an accelerator, such as a melamine crosslinking agent or an accelerator, can be included with a polyester polyol reagent to form an overcoating layer. Incorporation of a crosslinking agent or accelerator provides reaction sites to interact with the polyester polyol to provide a branched, crosslinked structure. When so incorporated, any suitable crosslinking agent or accelerator can be used, including, for example, trioxane, melamine compounds and mixtures thereof. Where melamine compounds are used, they can be suitably functionalized to be, for example, melamine formaldehyde, methoxymethylated melamine compounds, such as glycouril formaldehyde, benzoguanamine formaldehyde and the like.

Crosslinking generally is accomplished by heating in the presence of a catalyst. Thus, the solution of the polyester polyol also can include a suitable catalyst. Typical catalysts include, for example, oxalic acid, maleic acid, carbollylic acid, ascorbic acid, malonic acid, succinic acid, tartaric acid, citric acid, p-toluenesulfonic acid, methanesulfonic acid and the like and mixtures thereof.

If desired or necessary, a blocking agent also can be included. A blocking agent can be used to, "tie up," or block an acid effect to provide solution stability until an acidic catalyst function is desired. Thus, for example, the blocking agent can block an acid effect until the solution temperature is raised above a threshold temperature. For example, some blocking agents can be used to block an acid effect until the solution temperature is raised above about 100° C. At that time, the blocking agent dissociates from the acid and vaporizes. The unassociated acid is then free to catalyze polymerization. Examples of such suitable blocking agents include, but are not limited to, pyridine and commercial acid solutions containing such blocking agents.

Any suitable alcohol solvent may be employed for the film-forming material. Typical alcohol solvents include, for example, butanol, propanol, methanol, 1-methoxy-2-propanol and the like and mixtures thereof. Other suitable solvents that can be used in forming the overcoating layer solution include, for example, tetrahydrofuran, monochlorobenzene and mixtures thereof. The solvents can be used in addition to, or in place of, an alcohol solvent.

A hole transport material, which may be symmetric, may be used in the overcoat layer to improve charge transport mobility of the layer. The hole transport material can be, for example, a terphenyl hole transporting molecule, such as, a terphenyl diamine hole transporting molecule or a fluoroacyl arylamine of interest. In some embodiments, the hole transporting molecule is soluble in alcohol to assist in application along with the polymer or film-forming material or binder in solution form. However, alcohol solubility is not required and the combined hole transporting molecule and film-forming material or binder can be applied by methods other than in solution, as needed.

An overcoat may comprise a dispersion of nanoparticles, such as silica, metal oxides, waxy polyethylene particles, polytetrafluoroethylene (PTFE) and the like. The nanoparticles may be used to enhance lubricity, scratch resistance and wear resistance of an overcoat layer. In embodiments, the nanoparticles are comprised of nanopolymeric gel particles of crosslinked polystyrene-n-butyl acrylate dispersed or embedded in a film-forming material, binder or polymer matrix.

In embodiments, an overcoat layer may comprise a charge transport molecule or component, which may be symmetric. The charge transport molecule may be present in some embodiments in an amount from about 1% to about 60% by weight of the total weight of an overcoat layer.

The thickness of the overcoat layer can depend on the abrasiveness of the charging (e.g., bias charging roll), cleaning (e.g., blade or web), developing (e.g., brush), transferring (e.g., bias transfer roll) etc. functions in the imaging device employed and can range from about 1 μm or about 2 μm to about 10 μm or about 15 μm or more. A thickness of between about 1 μm and about 5 μm can be used. Typical application techniques include spraying, dip coating, roll coating, extrusion coating, draw bar coating, wire wound rod coating and the like. The overcoat can be formed as a single layer or as multiple layers. Drying of the deposited coating may be obtained by any suitable conventional technique, such as, oven drying, infrared radiation drying, air drying and the like. The dried overcoating can transport holes during imaging. An overcoat may not have a high free carrier concentration as free carrier concentration can increase dark decay. The dark decay of an overcoat can be about the same as that of the unovercoated device.

In the dried overcoating layer, the composition can include from about 40% to about 90% by weight of film-forming material or binder, and from about 60% to about 10% percent by weight of other ingredients.

The basic film-forming materials and other non-photoactive components for constructing a layer, as well as the methods for making, applying and setting the layer on a photoreceptor under construction as described herein can be used for making the other layers taught herein.

Generally, temperatures required to form an overcoat limit the reactants that can be used in other functional layers or can have a negative impact on reactants currently used in other functional layers of a photoreceptor. For example, the temperature for setting and for curing an overcoat may impact the integrity and function of existing layers, such as a CTL. For example, N,N,N'N'-tetra(4-methylphenyl)-(1,1'-biphenyl)-4,4'-diamine crystallizes in a formed CTL when exposed to higher temperatures for applying and curing an overcoat when the CTL is constructed with matrices or binders commonly used in the manufacture of photoreceptors, where the matrices, films or binders have a lower $T_g$ than the temperatures used to make an overcoat layer and any other layer added over a CTL.

The Anti-Curl Back Coating Layer

An anti-curl back coating may be applied to the surface of a substrate opposite to that bearing the photoconductive layer(s) to provide flatness and/or abrasion resistance, such as, when a web configuration imaging device component is contemplated. The anti-curl back coating layer can comprise a film-forming material or binder, such as, thermoplastic organic polymers or inorganic polymers, that are electrically insulating or slightly semiconductive. The thickness of anti-curl back coating layers generally is sufficient to balance substantially the total forces of the layer or layers on the opposite side of a substrate. An example of an anti-curl back coating layer is described in U.S. Pat. No. 4,654,284, the disclosure of which is incorporated herein by reference in entirety. A thickness of from about 70 μm to about 160 μm can be used for a flexible device imaging component, although the thickness can be outside that range as a design choice.

Because conventional anti-curl back coating formulations can suffer from electrostatic charge build up due to contact friction between the anti-curl layer and, for example, backer bars, which can increase friction and wear, incorporation of compounds to dissipate charge, such as, nanopolymeric gel particles, into the anti-curl back coating layer can substantially eliminate charge build up. In addition to reducing electrostatic charge build up and reducing wear in the layer, a charge dissipating material, such as, nanopolymeric gel particles, may be used to enhance lubricity, scratch resistance and wear resistance of the anti-curl back coating layer. In some embodiments, the nanopolymeric gel particles are comprised of crosslinked polystyrene-n-butyl acrylate, which are dispersed or embedded in a film-forming material or binder, such as, a polymer or a matrix.

In embodiments, the anti-curl back coating layer may comprise a charge transport molecule or component, which may be symmetric, such as, a fluoroacyl arylamine molecule of interest. The charge transport molecule may be present from about 1% to about 60% by weight of the total weight of the anti-curl back coating layer.

The Undercoat

An undercoat may be present, and can be composed of a binder or a film-forming material or substance, such as, a resin, a casein, a phenolic resin, a polyol, such as, an acrylic polyol, an aminoplast resin, a polyvinyl alcohol, a nitrocellulose, an ethylene-acrylic acid copolymer, a polyamide, a polyurethane or a gelatin can be used, and the layer formed, for example, by dip coating. Examples of polyol resins include, but are not limited to, a polyglycol, a polyglycerol and mixtures thereof. The aminoplast resin can be, but is not limited to, urea, melamine and mixtures thereof.

In embodiments, phenolic resins can be considered condensation products of an aldehyde and a phenol in the presence of an acidic or basic catalyst. The phenol may be, for example, phenol, alkyl-substituted phenols, such as, cresols and xylenols, halogen-substituted phenols, such as, chlorophenol, polyhydric phenols, such as, resorcinol or pyrocatechol, polycyclic phenols, such as, naphthol and bisphenol A, aryl-substituted phenols, cyclo-alkyl-substituted phenols, aryloxy-substituted phenols and combinations thereof. The phenol compound may be for example, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols and combinations thereof. The aldehyde may be, for example, formaldehyde, paraformaldehyde, acetaldehyde, butyraldehyde, paraldehyde, glyoxal, furfuraldehyde, propinonaldehyde, benzaldehyde and combinations thereof. The phenolic resin may be, for example, selected from dicyclopentadiene-type phenolic resins, phenol novolak resins, cresol novolak resins, phenol aralkyl resins and combinations thereof, see U.S. Pat. Nos. 6,255,027, 6,155,468, 6,177,219 and 6,156,468, each incorporated herein by reference in entirety. Examples of phenolic resins include, but are not limited to, formaldehyde polymers with p-tert-butylphenol, phenol and cresol; formaldehyde polymers with ammonia, cresol and phenol; formaldehyde polymers with 4,4'-(1-methylethylidene)bisphenol; formaldehyde polymers with cresol and phenol; or formaldehyde polymers with p-tert-butylphenol and phenol.

Phenolic resins are commercially available and can be used as purchased or can be modified to enhance certain properties. For example, the phenolic resins can be modified with suitable plasticizers, including, but not limited to, a polyvinyl butyral, a polyvinyl formal, an alkyd, an epoxy resin, a phenoxy resin (bisphenol A or epichlorohydrin polymer), a polyamide, an oil and the like.

Various types of fine particles and metallic oxides can be added to adjust the resistance of the undercoat layer. Examples of such metallic oxides include alumina, zinc oxide, aluminum oxide, silicon oxide, zirconium oxide, molybdenum oxide, titanium oxide, tin oxide, antimony oxide, indium oxide, bismuth oxide and so on. Examples also include fine particles of tin-doped indium oxide, antimony-doped tin oxide and antimony-doped zirconium oxide. A single species of a metallic oxide can be used or two or more types can be used in combination. When two or more are used, the plural oxides can be used in the form of a solution or a fused substance. The average particle size of a metallic oxide can be about 0.3 μm or less, about 0.1 μm or less. In embodiments, metallic oxide particles can be surface treated. Surface treatments include, but are not limited to, exposure of the particles to aluminum laurate, alumina, zirconia, silica, a silane, a methicone, a dimethicone, sodium metaphosphate and the like and mixtures thereof.

The solvent used for preparing the undercoat, depending on the presence of additives therein, is one capable of, for example, effective dispersion of inorganic particles and dissolution of the film-forming material or substance. A suitable solvent can be an alcohol, such as those containing 1, 2, 3, 4, 5 or 6 carbons, such as, ethanol, n-propyl alcohol, isopropyl alcohol, n-butanol, t-butanol and sec-butanol. Further, to improve storage ability and particle dispersion, it is possible to use an auxiliary solvent. An example of such an auxiliary solvent is methanol, benzyl alcohol, toluene, methylene chloride, cyclohexane or tetrahydrofuran.

Inorganic pigments can be included in an undercoat, such as, a white pigment, such as, a titanium oxide, a zinc oxide and so on.

An electronic transport pigment may include an undercoat. Examples include perylenes, polycyclic quinones, indigos, quinacridones, bisazo compounds, phthalocyanines and so on.

When particles are dispersed in a binder, resin or film-forming material or substance to prepare an undercoat, the particles can be present in an amount of about 20 wt % to about 80 wt %; from about 40 wt % to about 60 wt %; or from about 50 wt % to about 60 wt % of the total weight of undercoat materials.

An ultrasonic homogenizer, ball mill, sand grinder or homomixer can be used to disperse the inorganic particles.

The method of drying the undercoat can be selected as appropriate in conformity with the type of solvent and film thickness, for example, by heating.

The film thickness of the undercoat layer can be about 0.1 μm to about 30 μm, from about 1 μm to about 20 μm, from about 4 μm to about 15 μm.

Thus, a CTL of interest is one which does not impact negatively any of the functions normally ascribed to a CTL and does not impact negatively the overall function of a photoreceptor, however, provides enhanced functional stability and variability of the CTL that is exposed to higher temperatures, thereby extending beneficial properties of a photoreceptor containing an overcoat, such as, extended use under high speed printing conditions. Thus, the electrical properties of a photoconductor or photoreceptor of interest, as evidenced, for example, by PIDC's, are comparable to that of a control photoreceptor not containing or lacking a CTL composed of, in part or in whole a charge transport material other than a fluoroacylated arylamine; and by print quality, when in an imaging device, which is comparable to that of a control imaging device comprising a photoreceptor lacking a CTL composed of, in part or in whole a charge transport material other than a fluoroacylated arylamine, as evidenced, for example, by ghosting studies.

A CTL of interest is used in a photoreceptor as provided herein. The remaining layers to yield a functional photoreceptor are added to a substrate, at least a CGL and an overcoat, as taught herein or as known in the art. A CTL of interest can be used with any organic photoreceptor independent of the specific substrate, CGL and overcoat, and of the specific other layers that comprise a photoreceptor. The completed photoreceptor comprising a CTL comprising a fluoacylated arylamine is engaged in an imaging device as known in the art to enable the production of an image product, for example, photocopies. Such an imaging device can comprise a device for producing and removing an imagewise charge on the photoreceptor. The imaging device can contain a developing component for applying a developing composition, such as a finely divided pigmented material to said charge retentive surface of said photoreceptor to yield the image on the surface of said photoreceptor. Such an imaging device also may include an optional transferring component for transferring the developed image from the photoreceptor to another member or a copy substrate or receiving member. The imaging device comprises a device to enable transfer of the image from the photoreceptor to a receiving member, such as, a paper. The imaging device also can contain a component for affixing the finely divided pigmented material onto the receiving member. The imaging device also can comprise a device to recharge the photoreceptor to remove all charge from the surface thereof to provide a cleared surface on the photoreceptor to accept a new image without any remnants of the prior image, all, as well known in the art.

Various aspects of the embodiments of interest now will be exemplified in the following non-limiting examples.

EXAMPLES

Example 1

Synthesis of DFA-TBD

To a 100 ml flash containing 30 ml DCM (dichloromethane) were added 2.44 g (5.0 mmol, 1.0 equivalent) of TBD (tetraphenylenebiphenyldiamine) to yield a beige slurry. Then, 5.6 ml (40 mmol, 8.0 equivalents) of TFAA (trifluoroacetic anhydride) were poured into the mixture and the flask equipped with a reflux condenser. The mixture was heated to reflux (40° C.), the TBD dissolving to form a dark brown solution. The reaction was stirred for 72 hours at the reflux temperature.

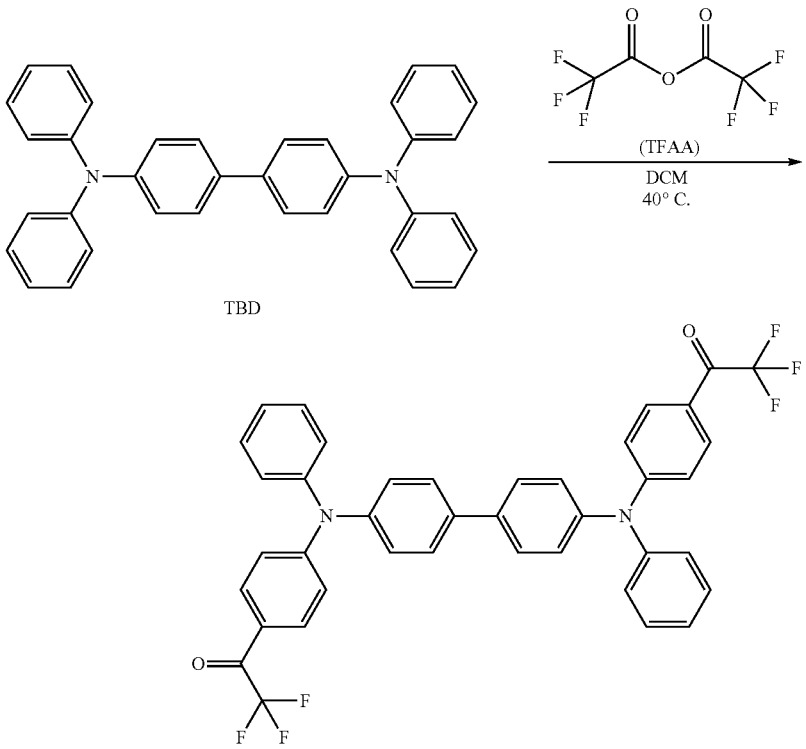

When the reaction was complete (determined by HPLC to be >99% conversion) the mixture was cooled to room temperature and then diluted with 30 ml DCM. The solution was then poured into 25 ml of stirring $H_2O$. The organic layer was isolated and washed with two 10 ml portions of a 1/1 mixture of $H_2O$/saturated $NaHCO_3$ and one 10 ml portion of an NaCl buffer, such as, a saturated NaCl solution. The aqueous wash which contains the acid byproduct was removed. That solution has a pH approaching neutral. The DCM solution then was dried with $Na_2SO4$ and removed by evaporation to yield DFA-TBD (di(trifluoroacyl) TBD) as 1.2 g (70%) of a golden yellow solid. The chemical structure was confirmed by nuclear magnetic resonance with $^1H$ NMR (300 MHz, $CH_2Cl_2$-d2) δ 7.93 (d, J=8.4 Hz, 4H), 7.60 (d, J=8.4 Hz, 4H), 7.42 (dd, J=7.3 Hz, 2H), 7.27-7.24 (12H), 7.04 (d, J=9.0 Hz, 4H); and $^{19}F$ NMR (300 MHz, $CH_2Cl_2$-d2) δ 71.2 (s, 6F).

Example 2

Synthesis of DFA-pTBD

To a 100 ml flask containing 30 ml DCM were added 2.58 g (5.0 mmol, 1.0 equivalent) of pTBD (para-methyl TBD) to yield a beige slurry. Then, 2.8 ml (20 mmol, 8.0 equivalents) of TFAA were poured into the mixture and the flask equipped with a reflux condenser. The mixture was heated to reflux (40° C.), the reagent dissolving to form a dark red-brown solution. The reaction was stirred for 48 hours at the reflux temperature.

When the reaction was complete (determined by HPLC to be >99% conversion), the mixture was cooled to room temperature then diluted with 30 ml DCM. The solution was then poured into 25 ml of stirring $H_2O$. The organic layer was isolated and washed with two 10 ml portions of a 1/1 mixture of $H_2O$/saturated $NaHCO_3$ and one 10 ml portion of NaCl buffer. The neutral pH aqueous wash which contains the acid byproduct was removed. The DCM solution then was removed by evaporation to yield DFA-pTBD as 3 g (85%) of amber solid. The chemical structure was confirmed by nuclear magnetic resonance with $^1H$ NMR (300 MHz, $CH_2Cl_2$-d2) δ 7.91 (d, J=8.4 Hz, 4H), 7.58 (d, J=8.4 Hz, 4H), 7.27-7.10 (12H), 7.01 (d, J=9.3 Hz, 4H), 2.40 (s, 6H); and $^{19}F$ NMR (300 MHz, $CH_2Cl_2$-d2) δ 71.1 (s, 6F).

Example 3

Electronic Absorption Properties of TBD and pTBD and Fluoroacylated Derivatives Thereof The electronic absorption spectra in the UV and visible range of TBD and DFA-TBD were obtained and compared. An approximate 40 nm red shift of absorption bands in DFA-TBD relative to TBD was observed. Similarly, the electronic absorption spectra in the UV and visible range of pTBD and DFA-pTBD demonstrated an approximate 40 nm red shift of absorption bands for DFA-pTBD relative to pTBD.

Hence, the fluoroacyl groups alter HOMO-LUMO energy levels.

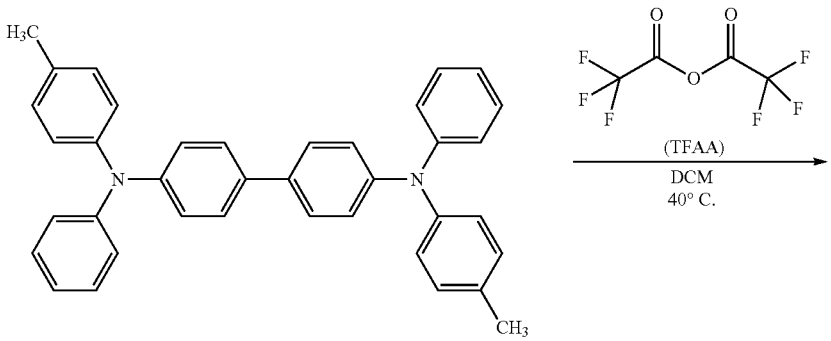

pTBD

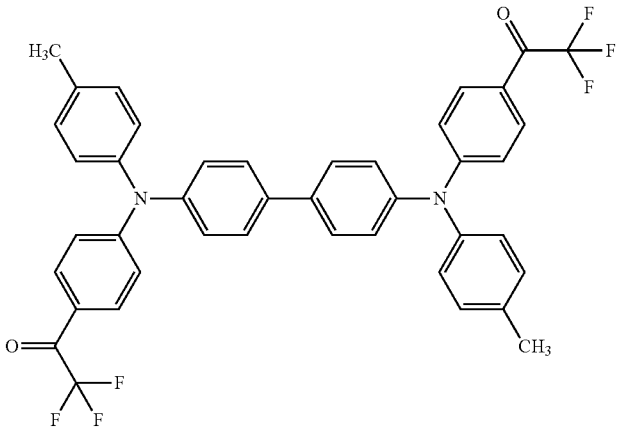

DFA - TBD

Example 4

Fabrication of a Charge Transport Device

Free standing films of DFA-TBD and DFA-pTBD were made with a 1:1 ratio of charge transport molecule and polycarbonate (PCZ-800). Solutions in DCM were cast as films onto metalized MYLAR substrates. The film was dried in an actively vented oven at 120° C. for 40 minutes. The dried film was delaminated by pealing and used for further testing.

Example 5

Charge Transport Properties

Time of flight measurements for both electrons and holes were made for DFA-TBD in polycarbonate as prepared and DFA-pTBD in polycarbonate as prepared in Example 4 above. The field used during measurement was at 2.8 $E^{-5}$ (V/cm).

The observed data demonstrate the charge transporting property of the fluoroacylated arylamines, which transport both holes and electrons with mobilities ranging from $10^{-6}$ to $10^{-5}$ $V^{-1}$ $s^{-1}$, comparable to known charge transport materials.

Example 6

Fabrication of a Photoreceptor Device and Testing

Polycarbonate (PCZ-800, Mitsubishi) and separately either DFA-TBD or DFA-pTBD were mixed in a 1:1 ratio and dissolved in DCM. Films were cast from the mixture onto TIGRIS (AMAT) substrates. The films were dried in an actively vented oven at 120° C. for 40 minutes. The films resulted in defect-free charged transport layers which were incorporated into a photoreceptor.

The photoreceptors, including a control which was a photoreceptor constructed in parallel but the CTL did not comprise a fluoroacyl arylamine of interest but a charge transport molecule available commercially, were tested in a UDS scanner set to obtain photoinduced discharge cycles, sequenced at one charge-erase cycle followed by one charge-expose-erase cycle, wherein the light intensity was incrementally increased with cycling to produce a series of photoinduced discharge characteristic curves (PIDC) from which the photosensitivity and surface potentials at various exposure intensities were measured. The scanner was equipped with a scorotron set to a constant voltage charging at various surface potentials. The photoconductors were tested at surface potentials of 700 volts with the exposure light intensity incrementally increased by regulating a series of neutral density filters; the exposure light source was a 780 nm xenon lamp. The xerographic simulation was conducted in an environmentally controlled light tight chamber at dry conditions (10% relative humidity and 22° C.). The devices were tested for $V_{high}$ and $V_{low}$ with a 780 nm exposure and erase, and 117 ms timing.

The PIDC data for the above devices demonstrated suitable charging by the fluoroacylated arylamines of interest, comparable to that of the known charge transport molecule.

All references cited herein are herein incorporated by reference in entirety.

It will be appreciated that variants of the above-disclosed and other features and functions, or alternatives thereof, may be combined with other and different systems or applications. Various presently unforeseen or unanticipated alternatives, changes, modifications, variations or improvements subsequently may be made by those skilled in the art to and based on the teachings herein without departing from the spirit and scope of the embodiments, and which are intended to be encompassed by the following claims.

What is claimed is:

1. A photoreceptor charge transport layer (CTL) comprising a film-forming material or a polymer and a fluoroacyl arylamine.

2. The CTL of claim 1, wherein said fluoroacyl arylamine comprises:

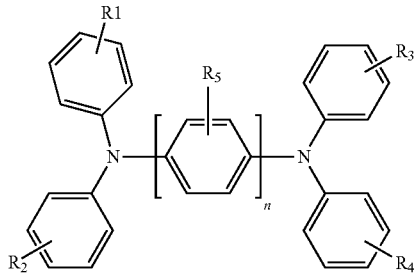

wherein each of $R_1$, $R_2$, $R_3$, $R_4$ and $R_5$ is located at any site of a phenyl group; and is one or more of a hydrogen atom; a halogen; a hydrocarbon of 1 to about 8 carbon atoms, which can be substituted and which can comprise a heteroatom; or a functional group; n is 1, 2 or 3; and one or more fluoroacyl moieties are attached to one or more phenyl or phenylene groups.

3. The CTL of claim 1 comprising:

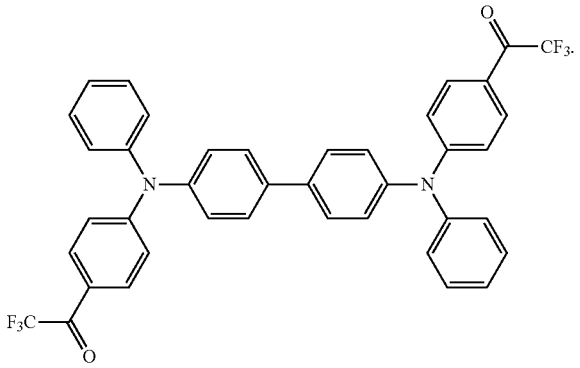

DFA-TBD

4. The CTL of claim 1 comprising:

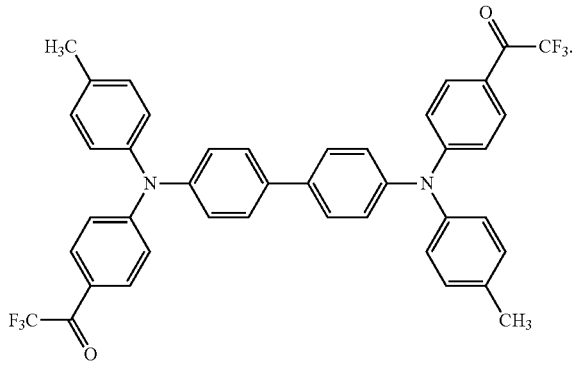

DFA-pTBD

5. The CTL of claim 1, wherein said fluoroacyl arylamine comprises structure A or B:

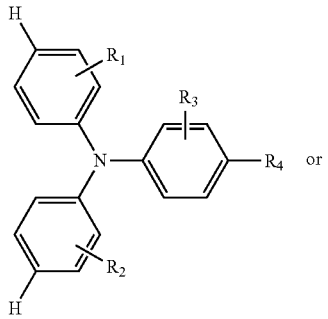

or

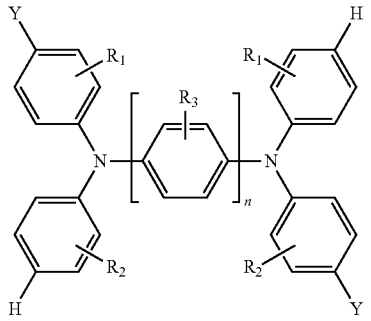

wherein Y is hydrogen, $C_1$-$C_5$ alkyl, $C_3$-$C_7$ cyclic alkyl, $C_1$-$C_4$ alkoxy, hydroxy, ω-hydroxy substituted $C_2$-$C_8$ alkyl, halogen or aryl, optionally substituted with $C_1$-$C_5$ alkyl; $R_1$, $R_2$, and $R_3$ each is hydrogen, $C_1$-$C_5$ alkyl, $C_3$-$C_7$ cyclic alkyl, $C_1$-$C_4$ alkoxy, hydroxy, ω-hydroxy substituted $C_2$-$C_8$ alkyl, halogen or aryl, optionally substituted with $C_1$-$C_5$ alkyl; $R_4$ is $C_1$-$C_5$ alkyl, $C_3$-$C_7$ cyclic alkyl, hydroxy, ω-hydroxy substituted $C_2$-$C_8$ alkyl, halogen or aryl, optionally substituted with $C_1$-$C_5$ alkyl; and n is 1, 2 or 3; and at least one phenyl or phenylene group comprises at least one fluoroacyl moiety.

6. The CTL of claim 5, wherein said structure B comprises:

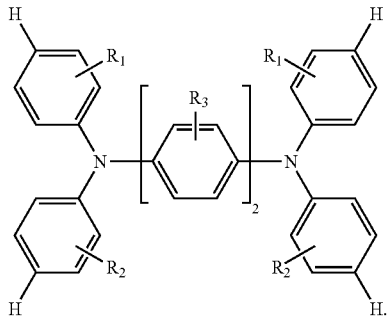

7. The CTL of claim 5, wherein said structure A or B comprises:

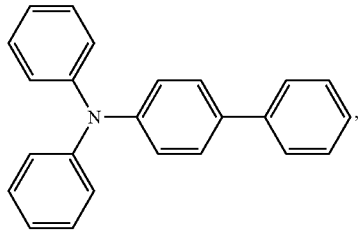

-continued

A

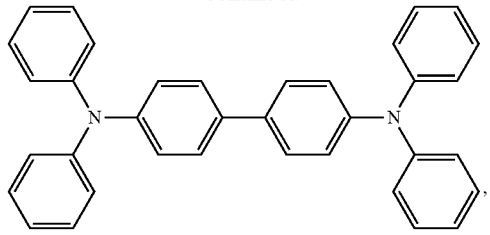

B

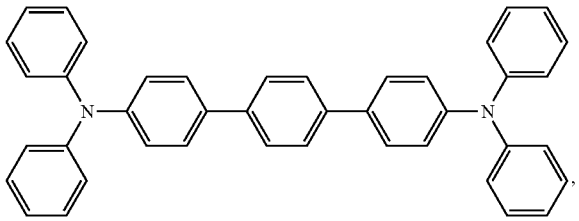

or

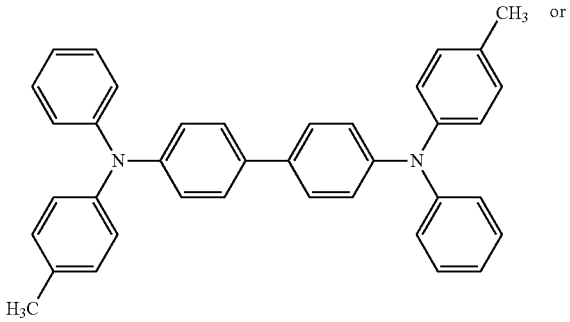

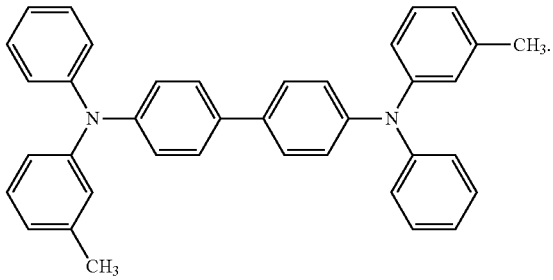

8. The CTL of claim 5, wherein Y is methyl.

9. The CTL of claim 1, wherein said fluoroacyl arylamine comprises:

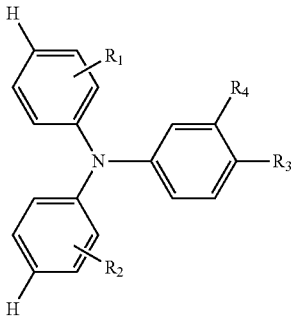

wherein $R_1$ $R_2$, and $R_3$ each is hydrogen, $C_1$-$C_5$ alkyl, $C_3$-$C_7$ cyclic alkyl, $C_1$-$C_4$ alkoxy, hydroxy, ω-hydroxy substituted $C_2$-$C_8$ alkyl, halogen or aryl, optionally substituted with $C_1$-$C_5$ alkyl; $R_4$ is $C_1$-$C_5$ alkyl, $C_3$-$C_7$ cyclic alkyl, hydroxy, ω-hydroxy substituted $C_2$-$C_8$ alkyl, halogen or aryl, optionally substituted with $C_1$-$C_5$ alkyl; and n is 1, 2 or 3; and at least one phenyl or phenylene group comprises a fluoroacyl moiety.

10. The CTL of claim 1 comprising:

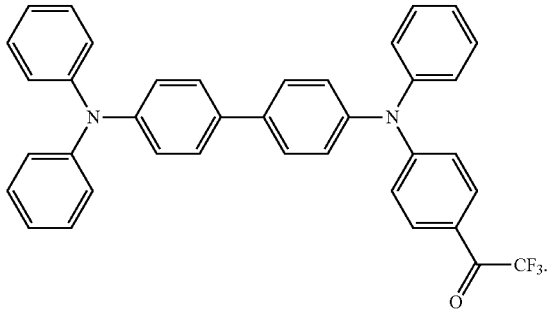

11. The CTL of claim 1, comprising:

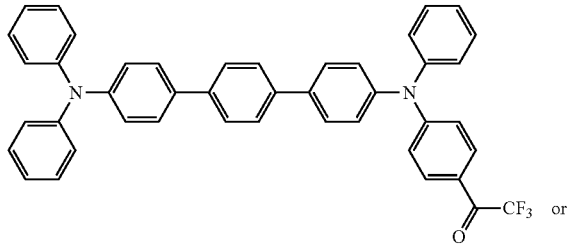

or

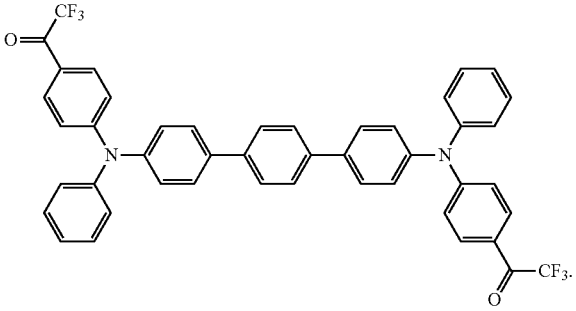

12. The CTL of claim 1, comprising:

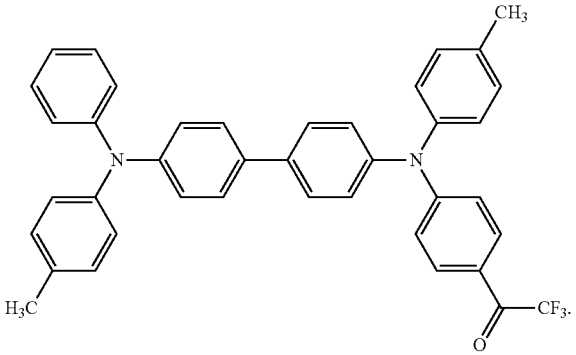

13. The CTL of claim 1, comprising,

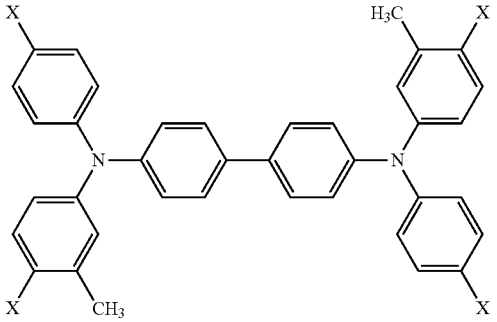

wherein, X is a fluoroacyl group or hydrogen and the number of fluoroacyl groups ranges from 1 to 4.

14. A photoreceptor comprising an electrically conductive substrate or a substrate having an electrically conductive layer thereon, a charge generating layer comprising a charge generating or photoconductive material and the CTL of claim 1.

15. An imaging device comprising the photoreceptor of claim 14.

16. The CTL of claim 1, wherein said fluoroacyl arylamine comprises

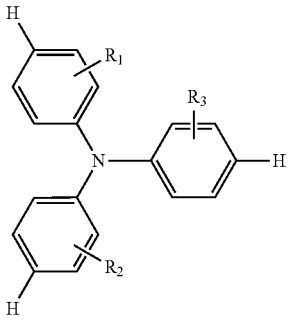

wherein $R_1$, $R_2$, and $R_3$ each is hydrogen, $C_1$-$C_5$ alkyl, $C_3$-$C_7$ cyclic alkyl, $C_1$-$C_4$ alkoxy, hydroxy, w-hydroxy substituted $C_2$-$C_8$ alkyl, halogen or aryl, optionally substituted with $C_1$-$C_5$ alkyl; and at least one phenyl or phenylene group comprises at least one fluoroacyl moiety.

17. The CTL of claim 1, wherein said fluoroacyl arylamine comprises

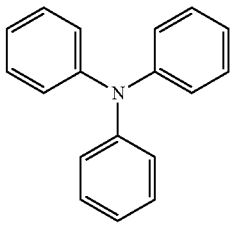

and one or more fluoroacyl moieties are attached to one or more phenyl groups.

18. A photoreceptor charge transport layer (CTL) comprising a film-forming material or a polymer and a fluoroacyl arylamine, wherein said fluoroacyl arylamine is prepared by reacting an arylamine with a fluoroacyl-donating reagent in the absence of a Lewis acid.

19. The CTL of claim 18, wherein said reagent comprises trifluoroacetic anhydride.

20. The CTL of claim 18, wherein said fluoroacyl arylamine comprises structure A or B:

A

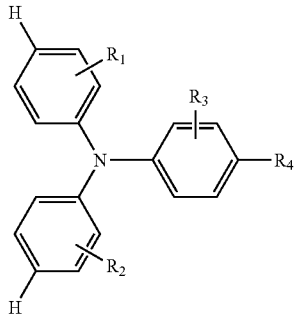

or

-continued

B

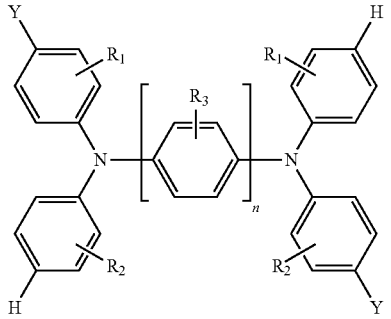

wherein Y is hydrogen, $C_1$-$C_5$ alkyl, $C_3$-$C_7$ cyclic alkyl, $C_1$-$C_4$ alkoxy, hydroxy, o-hydroxy substituted $C_2$-$C_8$ alkyl, halogen or aryl, optionally substituted with $C_1$-$C_5$ alkyl; $R_1$, $R_2$, and $R_3$ each is hydrogen, $C_1$-$C_5$ alkyl, $C_3$-$C_7$ cyclic alkyl, $C_1$-$C_4$ alkoxy, hydroxy, ω-hydroxy substituted $C_2$-$C_8$ alkyl, halogen or aryl, optionally substituted with $C_1$-$C_5$ alkyl; $R_4$ is $C_1$-$C_5$ alkyl, $C_3$-$C_7$ cyclic alkyl, hydroxy, w-hydroxy substituted $C_2$-$C_8$ alkyl, halogen or aryl, optionally substituted with $C_1$-$C_5$ alkyl; and n is 1, 2 or 3; and at least one phenyl or phenylene group comprises at least one fluoroacyl moiety.

* * * * *